United States Patent [19]

McMath

[11] 4,235,266

[45] Nov. 25, 1980

[54] LIQUID DISPENSING NOZZLE HAVING VAPOR RECOVERY SEALING ARRANGEMENT

[75] Inventor: Jack A. McMath, Fort Thomas, Ky.

[73] Assignee: Dover Corporation, New York, N.Y.

[21] Appl. No.: 970,814

[22] Filed: Dec. 18, 1978

[51] Int. Cl.[3] ..... B65B 3/18

[52] U.S. Cl. ..... 141/285; 141/311 R; 141/DIG. 1

[58] Field of Search ..... 141/52, 59, 97, 198, 141/206, 207, 285, 287, 290–293, 311 R, 392, DIG. 1

[56] References Cited

U.S. PATENT DOCUMENTS

| | | | |
|---|---|---|---|
| 3,990,490 | 11/1976 | Voelz | 141/311 R |
| 4,008,728 | 2/1977 | Moskovich | 141/311 R |
| 4,108,223 | 8/1978 | Hansel | 141/392 |

*Primary Examiner*—Frederick R. Schmidt

*Attorney, Agent, or Firm*—Kinney & Schenk

[57] ABSTRACT

A liquid dispensing nozzle has an eccentrically mounted seal at one end of a bellows, which is disposed in spaced relation to the spout of a nozzle to form an annular vapor return passage therebetween, to engage a fill pipe of a tank to form a seal therewith when the spout is disposed therein so that vapor flows from the tank to the annular vapor return passage of the nozzle. The seal includes a compressible member for engaging the fill pipe, a swivel plate, and a cap surrounding the bellows whereby the seal is removably fastened to the bellows for easy replacement. The swivel plate is pivotally connected to a spring, which surrounds the spout, so that the seal can pivot about two orthogonal axes with respect to the spout. The pivotal connection of the swivel plate to the spring is on top of the spout so that the maximum force of the spring is applied to the maximum eccentric surface of the seal.

26 Claims, 16 Drawing Figures

LIQUID DISPENSING NOZZLE HAVING VAPOR RECOVERY SEALING ARRANGEMENT

When filling a vehicle tank with gasoline through a dispensing nozzle, vapors from the gasoline with the tank escape therefrom through the opening of the fill pipe in which the spout of the nozzle is inserted. This escape of the vapors into the atmosphere pollutes the air.

It has previously been suggested to provide a gasoline dispensing nozzle with a vapor return passage and a sealing arrangement between the fill pipe of the tank being filled and the vapor return passage of the nozzle. Because of the large number of different types of vehicles and the various angles of the fill pipes due to the location of the fill pipe in each of the vehicles, the previously suggested sealing arrangements have not always been effective for all fill pipes.

The present invention is an improvement of the previously suggested sealing arrangement in that it enables a seal to be maintained between the fill pipe and the vapor return passage of the nozzle for any type of fill pipe irrespective of its angle. The present invention accomplishes this by mounting the seal so that the seal can pivot about two orthogonal axes with respect to the spout. Thus, the seal will engage the fill pipe opening irrespective of the angle of the fill pipe into which the spout is inserted because of the capability of the seal pivoting about two orthogonal axes with respect to the spout.

This mounting arrangement of the seal enables the compressible, sealing member, which engages the fill pipe, to be formed of either a soft or hard material. Thus, it is not necessary that the sealing member be formed of relatively soft material in order to engage the fill pipe opening irrespective of the angle of the fill pipe into which the spout is inserted.

If the sealing member is formed of a relatively soft material, it will tend to wear quicker than a seal of relatively hard material such as utilized in U.S. Pat. No. 3,866,636 to Lasater, for example. Therefore, if the sealing member is formed of a soft material, it is necessary to be able to replace the soft sealing member easily and quickly without affecting the remainder of the vapor recovery arrangement.

The present invention accomplishes this through removably fastening the sealing member so that only the removal of a pair of fastening screws is necessary for the soft sealing member to be disconnected. It is then only necessary to dispose another soft sealing member for connection to the bellows by the fastening screws.

In most fill pipes, the angle of the fill pipe is such that a greater force is applied to the seal at the top of the spout because of the angle of the fill pipe into which the spout is inserted. The present invention obtains a more balanced load on the fill pipe through producing a greater spring force on the top portion of the seal. This is accomplished through connecting the spring, which is exerting the force on the seal, only to the top portion of the seal; this top portion receives the greatest force from engagement with the fill pipe.

To more effectively utilize this force on the top portion of the seal, the seal is formed with its fill pipe engaging surface eccentrically disposed with respect to the longitudinal axes of the bellows and spout when in a rest position, which is when the seal is not engaging any fill pipe. The present invention orients the eccentricity of the fill pipe engaging surface of the seal so that the maximum eccentricity is at the top.

Furthermore, the connection of the spring only to the top portion of the seal prevents generation of a torque on the seal if the nozzle is pulled to one side during insertion into the fill pipe. This generation of a torque could cause the seal to cease to completely engage the fill pipe. Accordingly, the absence of the torque, due to the single connection of the spring at the top of the seal, prevents the possibility of the seal ceasing to be fully in sealing engagement with the fill pipe when the spout is pulled to one side during insertion into the fill pipe.

One presently suggested seal has utilized a plate bonded to a member of relatively soft material engaging the fill pipe. In some instances, it has been difficult to obtain the desired bonding because of the softness of the sealing material and/or the chemical composition of the material. This has made the assembly time consuming and expensive.

The present invention overcomes this problem through utilizing a plate having only a mechanical connection with the sealing member engaging the fill pipe. This is a much easier and less expensive assembly than the previous seal having a sealing member of a relatively soft sealing material.

In connecting the seal to the bellows, a positive retention of the seal on the bellows is obtained through having portions of the seal engage both the inner and outer surface of the outer end of the bellows and then clamp the outer end of the bellows therebetween. This arrangement insures that the outer end of the bellows is positively retained within the seal and cannot be accidentally disconnected.

An object of this invention is to provide a unique vapor recovery seal for a liquid dispensing nozzle.

Another object of this invention is to provide a vapor recovery seal for a liquid dispensing nozzle in which the seal is capable of pivoting in two orthogonal planes.

A further object of this invention is to provide a vapor recovery seal for a liquid dispensing nozzle in which the sealing surface is eccentrically disposed with respect to the spout.

Still another object of this invention is to provide a vapor recovery seal for a liquid dispensing nozzle in which the seal is positively retained on the member connecting the seal to the nozzle body.

Other objects, uses, and advantages of this invention are apparent upon a reading of this description, which proceeds with reference to the drawings forming part thereof and wherein.

Figure 1:
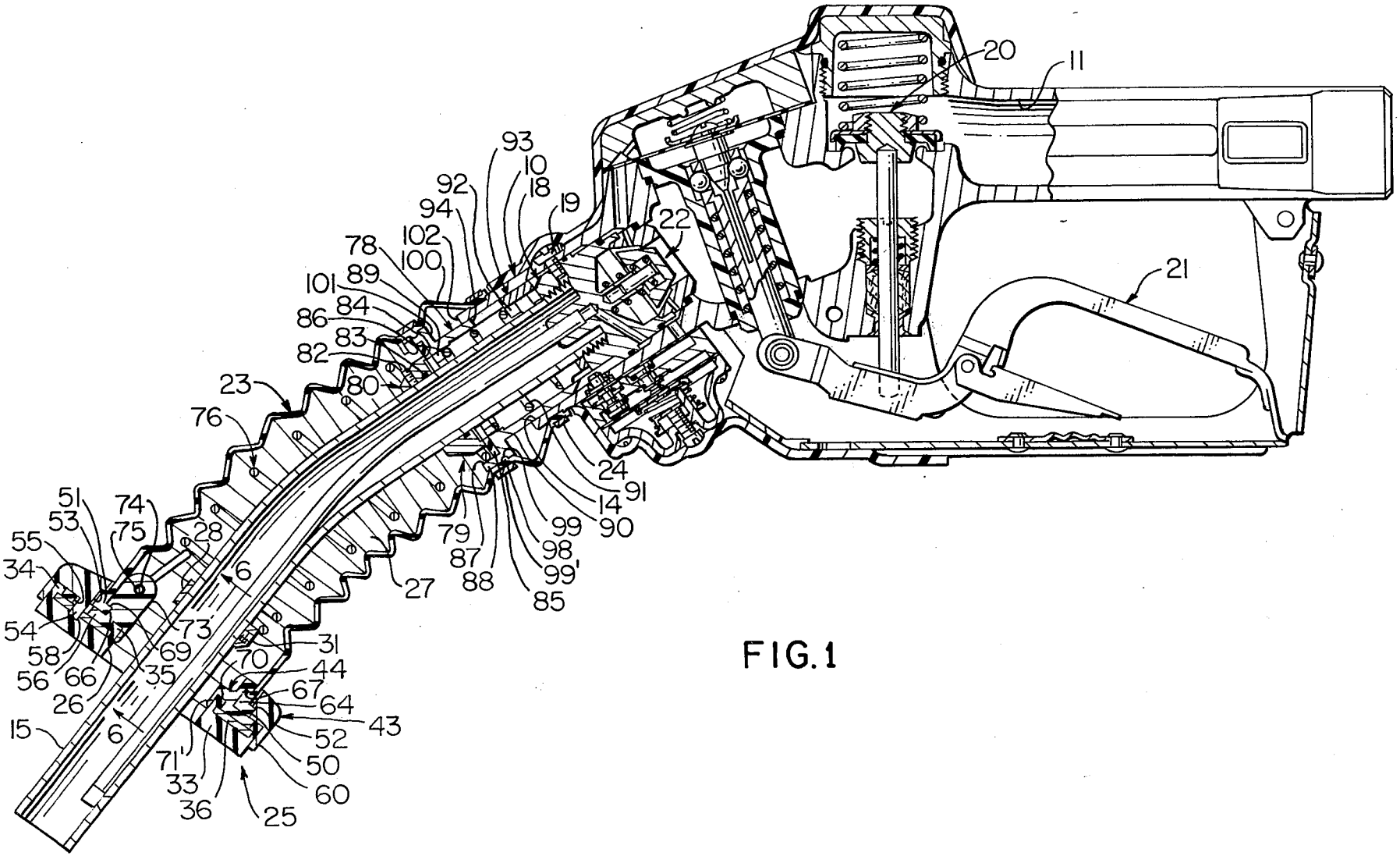
FIG. 1 is a sectional view, partly in elevation, of a liquid dispensing nozzle having the vapor recovery sealing arrangement of the present invention.

Referring to the drawings and particularly FIG. 1, there is shown a liquid dispensing nozzle including a nozzle body 10. The nozzle body 10 has an inlet 11 to which a hose is connected to supply liquid such as gasoline, for example, to the interior of the body 10. The body 10 has an outlet 14 with which a spout 15 communicates to receive liquid from the interior of the body 10.

The spout 15, which is adapted to be inserted within an opening 16 (see FIG. 2) in a fill pipe 17 of a vehicle tank such as an automobile fuel tank, for example, has an end threaded in a spout adapter 18 (see FIG. 1). The spout adapter 18 is connected to the outlet 14 by the body 10 by a screw 19.

The body 10 has a first or main poppet valve 20, which is controlled by a manually operated lever or handle 21, and a second poppet valve 22 therein. The valves 20 and 22 control the flow to the spout 15 in the manner more particularly shown and described in U.S. Pat. No. 3,823,752 to Lasater et al.

The outlet 14 of the body 15 has one end of a bellows 23, which is preferably formed of synthetic rubber, secured thereto by being held thereon by a clamp 24. The outer end of the bellows 23 has a sealing means 25 removably fastened thereto. The sealing means 25 has an enlarged central opening 26 to enable the sealing means 25 to slide along the spout 15.

Figure 2:
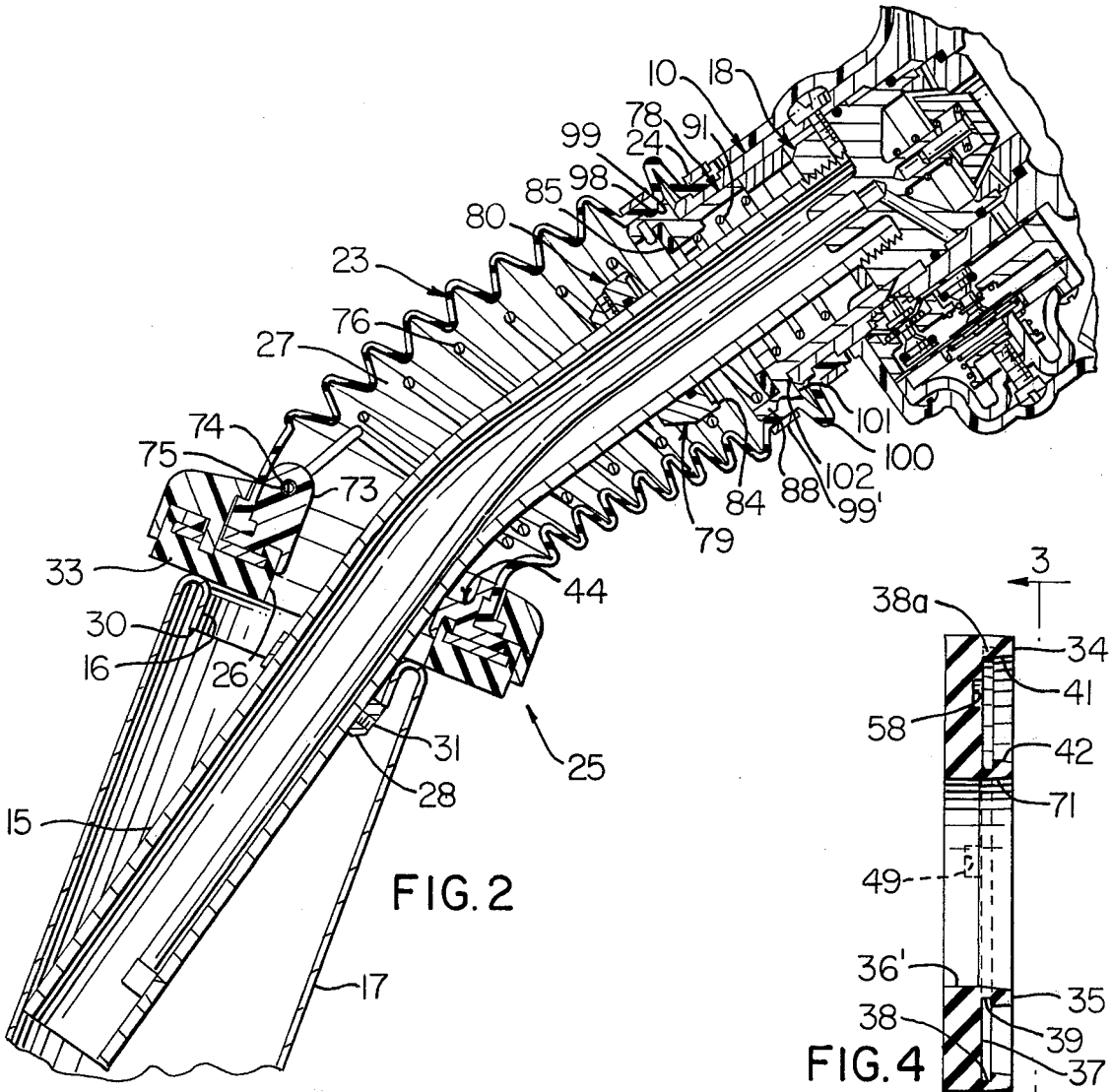
FIG. 2 is a fragmentary sectional view, partly in elevation, of the nozzle of FIG. 1 with the spout of the nozzle disposed in the fill pipe of a vehicle tank to be sealed and the vapor recovery seal being effective.

When the spout 15 is inserted in the fill pipe opening 16 as shown in FIG. 2, the sealing means 25 engages the end of the fill pipe 17 to form a seal therewith through being compressible. Thus, any vapor within the tank being filled can flow from the tank through the fill pipe opening 16 and the opening 26 in the sealing means 25 into an annular passage 27, which is formed between the bellows 23 and the spout 15.

The spout 15 has a latch ring 28 formed thereon for engagement with a lip 30 of the fill pipe 17 to hold the free end of the spout 15 within the fill pipe 17. The latch ring 28 is secured to the spout 15 by a set screw 31.

As shown in FIG. 1, the sealing means 25 includes a sealing member 33 having sealing engagement with the end of the fill pipe 17 as shown in FIG. 2 when the spout 15 is inserted into the fill pipe 17. The sealing member 33 is formed of any suitable compressible material, either hard or soft. One suitable example of the material of the member 33 is synthetic rubber having a hardness of 30 Duro on the Shore A scale.

The thickness of the sealing member 33 depends upon the material of which it is formed. The sealing member 33 must have sufficient thickness so that it will be resilient enough to form a seal with the fill pipe 17 but not so thick as to be too soft and not form the seal with the fill pipe 17.

Figure 4:
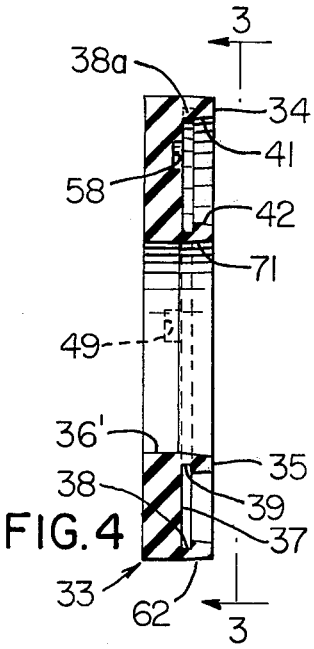
FIG. 4 is a sectional view of the sealing member of FIG. 3 and taken along line 4—4 of FIG. 3.
Figure 3:
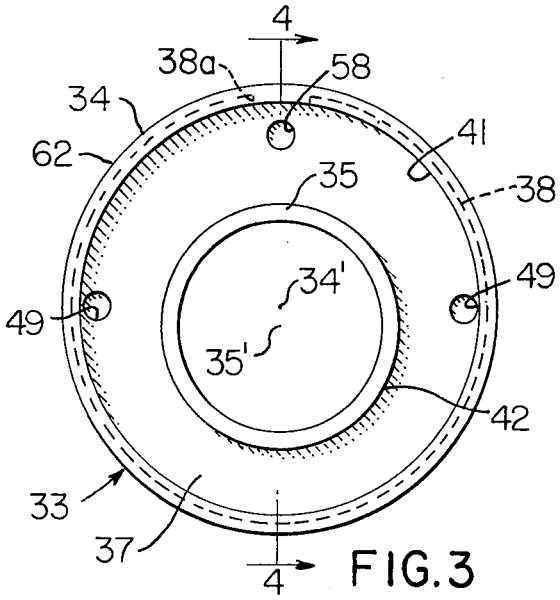
FIG. 3 is an end elevational view of the sealing member of the sealing means of the present invention taken along line 3—3 of FIG. 4.

As shown in FIGS. 3 and 4, the sealing member 33 includes an outer peripheral annular projection 34 on one side thereof formed with a center 34′ and an inner peripheral annular projection 35 on the same side of the sealing member 33 formed with a center 35′. Thus, the inner surface of the inner projection 35 defines an opening 36′ which is eccentric to the periphery of the sealing member 33. The opening 36′ forms part of the opening 26 of the sealing means 25.

Figure 5:
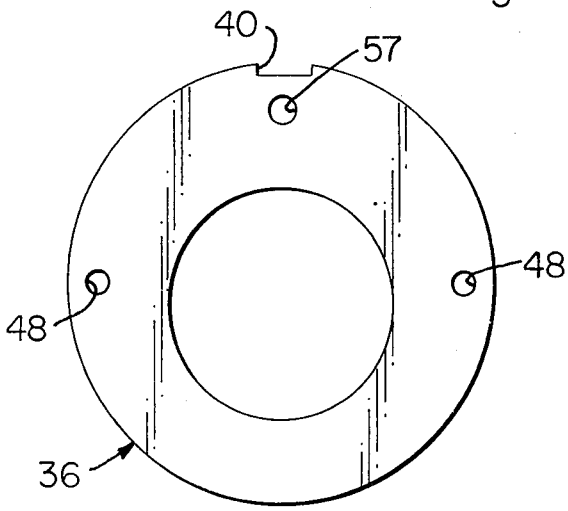
FIG. 5 is a rear elevational view of the seal plate of the sealing means of the present invention.

As shown in FIG. 1, the sealing member 33 has a seal plate 36 supported therein. The seal plate 36 is retained within a chamber or recess 37 (see FIG. 3), which is eccentric, in the sealing member 33 with the outer edge of the seal plate 36, which is eccentric so as to be disposed within the chamber 37, being disposed within an outer groove 38 (see FIG. 4), which has a projection or lug 38*a*, in the sealing member 33 and the inner edge of the seal plate 36 (see FIG. 5) being disposed within an inner groove 39 (see FIG. 4) in the sealing member 33.

The seal plate 36 has a slot 40 (see FIG. 5) formed in its outer edge to enable proper orientation of the seat plate 36 in the outer groove 38 of the sealing member 33 by aligning the slot 40 radially to receive the lug 38*a* in the outer groove 38. The seal plate 36 is inserted past the projections 34 (see FIGS. 3 and 4) and 35 of the sealing member 33 so as to be disposed within the chamber 37 in the sealing member 33. The outer projection 34 has its inner surface 41 (see FIG. 4) formed with a bevel of 3°. The inner projection 35 has its outer surface 42 also formed with a bevel of 3°. This tapered arrangement aids in inserting the seal plate 36 (see FIGS. 1 and 5) into the chamber 37 (see FIG. 4) in the sealing member 33.

In addition to the sealing member 33, the sealing means 25 includes an end cap 43 (see FIGS. 1 and 10–12) and a swivel plate 44 (see FIGS. 1 and 13–15). The end cap 43, the swivel plate 44, and the sealing member 33 are secured to each other and to the outer end of the bellows 23 by a pair of self-tapping screws 45 (see FIG. 6).

The screws 45 extend through a pair of diametrically disposed clearance passages or holes 46 (see FIGS. 6, 10 and 12) in the end cap 43, a pair of clearance passages or holes 47 (see FIGS. 6 and 13) in the swivel plate 44, and into a pair of diametrically disposed holes 48 (see FIGS. 3, 5, and 6) in the seal plate 36. The screws 45 (see FIG. 6) tap through the holes 48 in the seal plate 36 into a pair of diametrically disposed recesses 49 (see FIGS. 3 and 6) in the sealing member 33.

Figure 6:
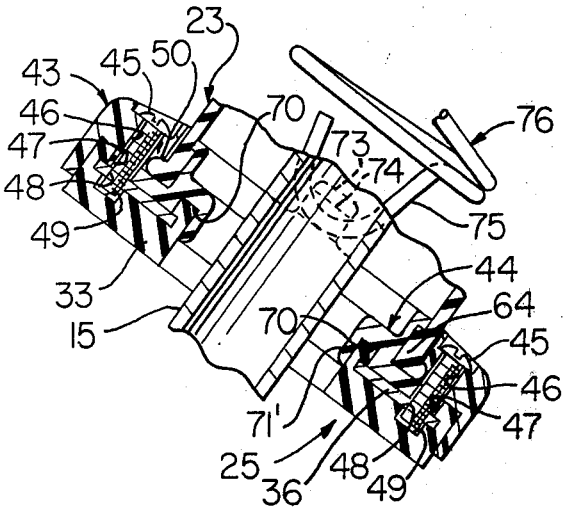
FIG. 6 is a fragmentary sectional view of the liquid dispensing nozzle of FIG. 1 showing the sealing means of the present invention and taken along line 6—6 of FIG. 1.

As shown in FIGS. 1 and 6, the end cap 43 fits over the outer surface of the outer end of the bellows 23 and the swivel plate 44 cooperates with the inner surface of the outer end of the bellows 23. Thus, the outer end of the bellows 23 is retained therebetween.

The outer end of the bellows 23 has a circumferential bead 50 on its outer surface. The bead 50 has an enlarged portion 51 (see FIGS. 8 and 9) along a small arcuate portion thereof with the word TOP (see FIG. 9) formed thereon to indicate the rotational orientation of the bellows 23 on the body 10 during mounting thereon. Thus, the enlarged portion 51 functions to position the sealing means 25 at the desired rotational location relative to the body 10.

The end cap 43 (see FIGS. 10–12) is formed with an inner circumferential groove 52 to receive the bead 50 on the outer surface of the bellows 23. The inner groove 52 has a deeper groove 53 (see FIGS. 10 and 11) to receive the enlarged portion 51 (see FIGS. 7–9) of the bellows 23. The deeper groove 53 extends for only a small portion of the circumference of the groove 52 as shown in FIG. 10.

The reception of the enlarged portion 51 (see FIGS. 7–9) of the bellows 23 within the deeper groove 53 in the end cap 43 is shown in FIG. 1. Thus, the reception of the enlarged portion 51 of the bellows 23 in the deeper groove 53 in the end cap 43 positions the end cap 43 at a desired angular location with respect to the bellows 23, which is positioned on the body 10 so that the enlarged portion 51 is at the top of the bellows 23 when the bellows 23 is mounted on the body 10.

Figure 10:
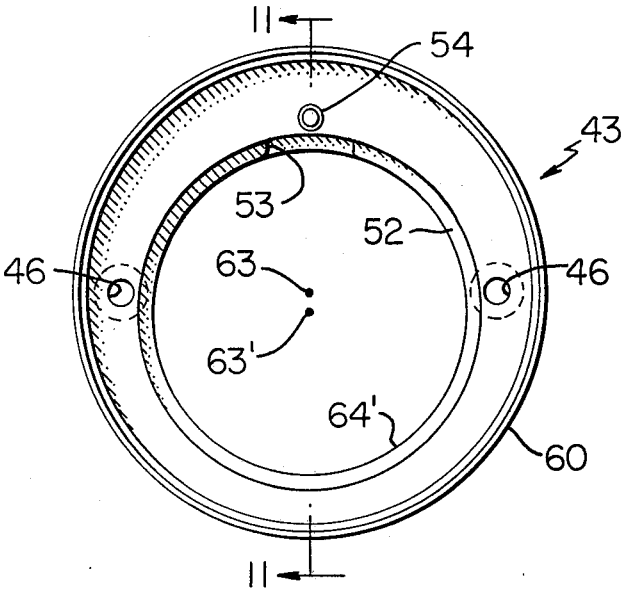
FIG. 10 is an end elevational view of one side of the end cap of the sealing means of the present invention and taken along line 10—10 of FIG. 11.
Figure 11:
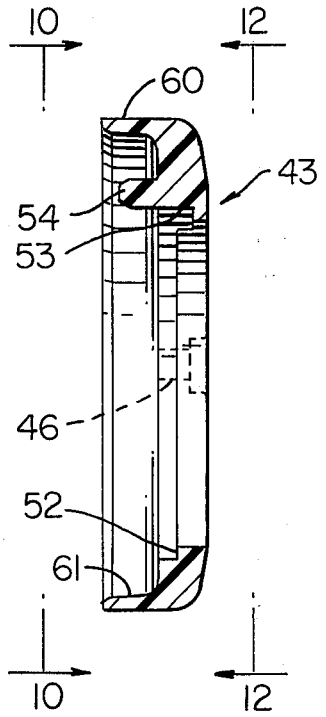
FIG. 11 is a sectional view of the end cap of FIG. 10 and taken along line 11—11 of FIG. 10.
Figure 12:
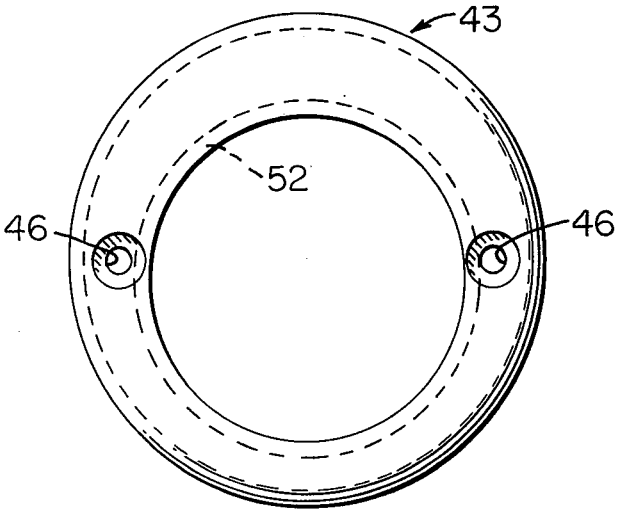
FIG. 12 is an end elevational view of the other side of the end cap of FIG. 11 and taken along line 12—12 of FIG. 11.
Figure 13:
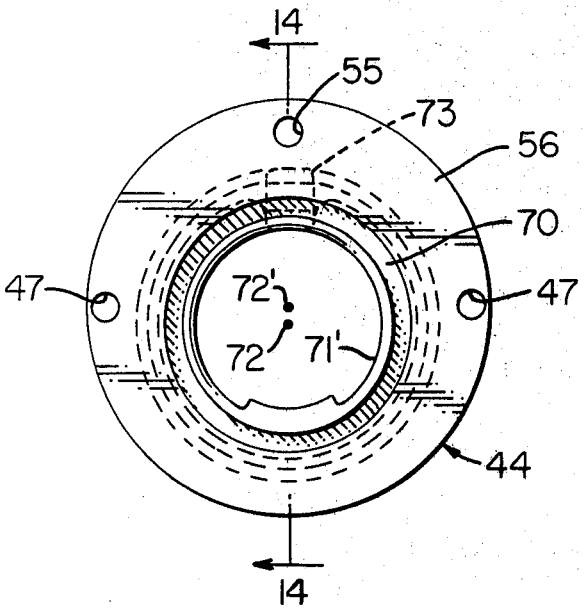
FIG. 13 is an end elevational view of the swivel plate of the sealing means of the present invention and taken along line 13—13 of FIG. 14.

The end cap 43 has a centering pin 54 disposed above the deeper groove 53, as shown in FIG. 10, for disposition within a passage or hole 55 (see FIGS. 1, 13, and 14) in a flat portion 56 of the swivel plate 44, a passage or hole 57 (see FIG. 5) in the seal plate 36, and a recess 58 (see FIGS. 1, 3, and 4) in the sealing member 33. This aligns the passages 46 (see FIGS. 6, 10, and 12) in the end cap 43, the passages 47 (see FIGS. 6 and 13) in the swivel plate 44, the holes 48 (see FIGS. 5 and 6) in the seal plate 36, and the recesses 49 (see FIGS. 3, 4, and 6) in the sealing member 33 to enable the reception of the self-tapping screws 45 (see FIG. 6) therethrough.

As shown in FIG. 1, the end cap 43 has an annular flange or projection 60 for disposition over the outer surface of the sealing member 33. The flange 60 has its inner surface 61 (see FIG. 11) formed with a bevel of 3°. The annular projection 34 (see FIG. 4) on the sealing member 33 has its outer surface 62 formed with a bevel of 3°. This aids in the sealing member 33 fitting within the flange 60 of the end cap 43 during assembly.

The flange 60 has its center 63 (see FIG. 10) aligned with the center 34' (see FIG. 3) of the sealing member 33. The groove 52 (see FIG. 10) in the end cap 43 has its center 63' displaced from the center 63 and aligned with the center 35' (see FIG. 3) of the sealing member 33. Thus, an opening 64' (see FIG. 10), which is defined by the inner surface of the end cap 43 and forms part of the opening 26 (see FIG. 1) of the sealing means 25, is eccentric to the outer surface of the flange 60 (see FIG. 10) of the end cap 43 in a manner similar to that shown for the sealing member 33 (see FIG. 3) and the seal plate 36 (see FIG. 5).

Figure 7:
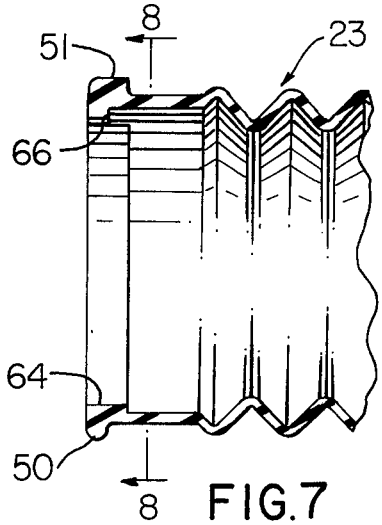
FIG. 7 is a fragmentary longitudinal sectional view of the outer end of the bellows of the liquid dispensing nozzle of FIG. 1.
Figure 8:
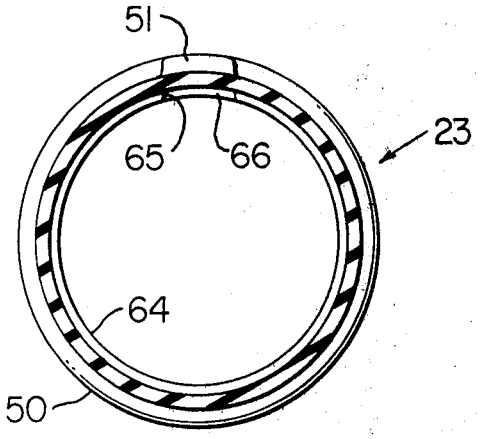
FIG. 8 is a cross sectional view, partly in elevation, of the bellows of FIG. 7 and taken along line 8—8 of FIG. 7.
Figure 9:
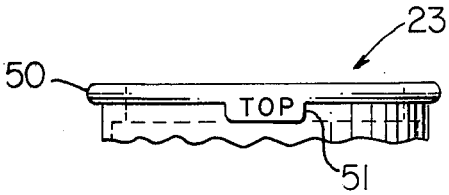
FIG. 9 is a fragmentary top plan view of the bellows of FIG. 7.

As shown in FIGS. 7 and 8, the outer end of the bellows 23 has an enlarged circumferential portion 64 on its inner surface. As shown in FIG. 7, the enlarged portion 64 extends longitudinally for the same length as the combined length of the enlarged portion 51 and the bead 50 on the outer surface of the outer end of the bellows 23. The enlarged portion 64 has an arcuate cut out portion 65 (see FIG. 8) to form a portion 66 (see FIG. 7) of reduced length in comparison with the length of the enlarged portion 64. As shown in FIG. 8, the reduced portion 66 extends for substantially the same arcuate distance as the enlarged portion 51.

Figure 14:
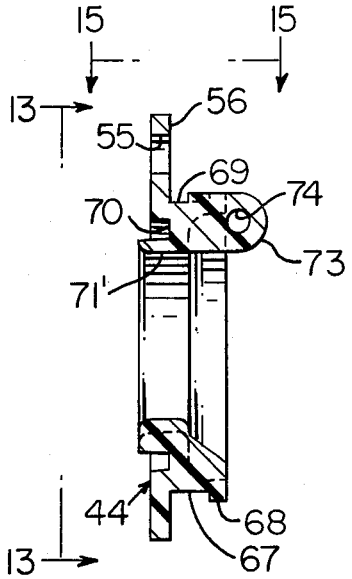
FIG. 14 is a sectional view of the swivel plate of the sealing means of the present invention and taken along line 14—14 of FIG. 13.
Figure 15:
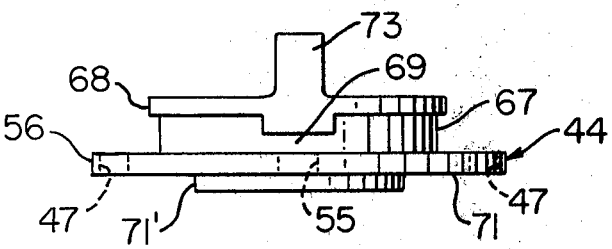
FIG. 15 is a side elevational view of the swivel plate of the sealing means and taken along line 15—15 of FIG. 14.
Figure 16:
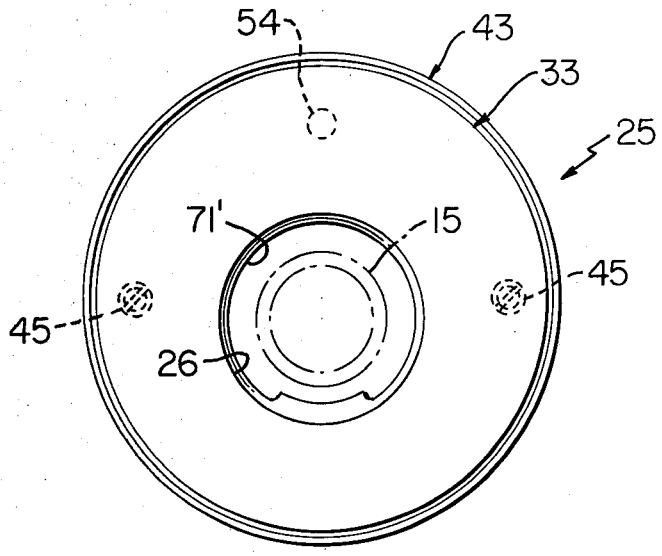
FIG. 16 is an end elevational view of the end of the sealing means which engages the fill pipe with the spout shown in phantom.

As shown in FIGS. 14 and 15, the swivel plate 44 is formed with a circumferential groove 67 in an upstanding portion 68 extending from the flat portion 56. The groove 67, which is adjacent the flat portion 56, has a reduced portion 69 as shown in FIGS. 14 and 15. The groove 67 receives the enlarged portion 64 (see FIGS. 7 and 8) of the bellows 23 with the portion 66 of the enlarged portion 64 being disposed in the reduced portion 69 of the groove 67. The disposition of the enlarged portion 64 of the bellows 23 within the groove 67 in the swivel plate 44 is shown in FIGS. 1 and 6 while the disposition of the portion 66 of the enlarged portion 64 of the bellows 23 within the reduced portion 69 of the groove 67 is shown only in FIG. 1.

The swivel plate 44 has a groove 70 (see FIGS. 13 and 14) in the lower surface of the flat portion 56. The groove 70 has each of its inner and outer surfaces formed with a bevel of 3°.

The groove 70 in the swivel plate 44 receives the inner projection 35 (see FIGS. 3 and 4) of the sealing member 33 as shown in FIGS. 1 and 6. The inner projection 35 has its inner surface 71 (see FIG. 4) formed with a bevel of 3°. As previously mentioned, the outer surface 42 of the inner projection 35 is similarly beveled. This aids in the inner projection 35 fitting within the groove 70 in the swivel plate 44 as shown in FIGS. 1 and 6. The swivel plate 44 has a flange 71' (see FIGS. 13–15) overlying the inner surface 71 (see FIG. 4) of the inner projection 35 as shown in FIGS. 1 and 6.

The groove 70 (see FIG. 13) in the swivel plate 44 has its center 72 displaced from a center 72' of the circumference of the flat portion 56 of the swivel plate 44. The center 72 is aligned with the center 35' (see FIG. 3) of the sealing member 33 as is required for the inner projection 35 of the sealing member 33 to be received within the groove 70 (see FIG. 13) in the swivel plate 44. The center 72' of the swivel plate 44 is aligned with the center 34' (see FIG. 3) of the sealing member 33.

The upstanding portion 68 (see FIGS. 14 and 15) of the swivel plate 44 has an ear or tab 73 projecting upwardly therefrom. The ear 73 has a passage or hole 74 extending therethrough to receive a looped end 75 (see FIGS. 1 and 6) of a spring 76.

The spring 76 extends from the ear 73 of the swivel plate 44 in surrounding relation to a portion of the spout 15 as shown in FIG. 1. The spring 76 has its other end formed as a tab (not shown) for disposition in an opening (not shown) in a slidable cylindrical member 78 (see FIG. 1), which is slidably supported within the outlet 14 of the body 10.

The looped end 75 of the spring 76 enables pivoting of the sealing means 25 about two orthogonal axes so that the sealing means 25 can pivot in two different planes. Each of these two pivot axes also is orthogonal to the longitudinal axis of the spout 15 and the longitudinal axis of the bellows 23. Thus, the sealing means 25 pivots about two axes orthogonal to the longitudinal axis of the spout 15 and the longitudinal axis of the bellows 23. This capability of the sealing means 25 being pivotal about the two orthogonal axes enables the sealing member 33 to engage the fill pipe 17 irrespective of the angle of the fill pipe 17.

The slidable cylindrical member 78 is a portion of a check valve 79, which also includes a seat ring 80 on the spout 15. The check valve 79 is more particularly shown and described in my copending application for "Liquid Dispensing Nozzle Having A Sealing Arrangement For Vapor Return Means," Ser. No. 696,975, filed June 17, 1976, continuation Ser. No. 856,110, filed Nov. 30, 1977, continuation Ser. No. 918,057, filed June 22, 1978, and assigned to the same assignee as the assignee of this application.

Both the ring 80 and the slidable member 78 are concentric to the longitudinal axis of the portion of the spout 15 on which the ring 80 is mounted. The ring 80 is secured to the spout 15 by suitable means such as a pair of set screws (one shown at 82) disposed 90° from each other, for example. The ring 80 has a groove in its inner surface to receive an O-ring 83 to form a seal with the outer surface of the spout 15 on which the ring 80 is mounted.

The ring 80 has an annular projection or shoulder 84 formed thereon adjacent its periphery for cooperation with an annular resilient disc 85, which is preferably formed of rubber and is fixed to an end face 86 of the slidable member 78 and retained thereon by the spring 76. The annular projection 84 on the ring 80 engages the resilient disc 85 intermediate its ends as shown in FIG. 1 to form a seal therebetween.

The resilient disc 85 is retained in the slidable member 78 within a recess 87, which is formed by an enlarged annular portion 88 on the slidable member 78. The portion 88 has the opening, which has the tab end of the spring 76 disposed therein, formed therein. Thus, a portion of the spring 76 is disposed in the recess 87.

The inner surface of the annular resilient disc 85 terminates in alignment with the inner ends of three lugs 89, which are equally angularly spaced from each other, at the junction of the enlarged annular portion 88 and a hollow cylindrical portion 90 of the slidable member 78. The resilient disc 85 has its flat surface, which is engaged by the annular projection 84 of the ring 80, substantially perpendicular to the longitudinal axis of the portion of the spout 15 on which the ring 80 is mounted. Thus, when there is relative movement between the ring 80 and the slidable member 78, there is axial motion of the resilient disc 85 relative to the annular projection 84 of the ring 80 in the direction of the longitudinal axis of the portion of the spout 15 having the ring 80 mounted thereon.

A spring 91, which has one end acting against the lugs 89 on the slidable member 78 and its other end acting against a ring 92 of a guide 93, continuously urges the resilient disc 85 of the sealing member 78 against the annular projection 84 on the ring 80 to seal the annular passage 27 from communication with the vapor recovery equipment. The guide 93 is disposed in a longitudinal slot 94 in the slidable member 78 to prevent relative rotation of the slidable member 78 during its sliding motion relative to the body 10. As more particularly shown and described in my copending patent application for "Automatic Shut-Off Nozzle With Vapor Return Seal," Ser. No. 684,441, filed May 7, 1976 continuation Ser. No. 856,108, filed Nov. 30, 1977, continuation Ser. No. 943,326, filed Sept. 18, 1978, continuation Ser. No. 059,970, filed July 23, 1979, and assigned to the same assignee as the assignee of this application, the guide 93 has a forked end to fit over a portion of the spout adapter 18 so as to not rotate with respect thereto so that relative rotation of the slidable member 78 with respect to the spout 15 is prevented.

In addition to having the longitudinal slot 94 formed in the hollow cylindrical portion 90 of the slidable member 78, the hollow cylindrical portion 90 has a longitudinal cut out portion (not shown) formed therein with its centerline 90° from the centerline of the slot 94 as shown and described in the copending patent application of Jack A. McMath et al for "Liquid Dispensing Nozzle Having A Sealing Arrangement For Vapor Recovery," Ser. No. 696,936 filed June 17, 1976, continuation Ser. No. 858,451, filed Dec. 8, 1977, and assigned to the same assignee as the assignee of this application. As more particularly shown and described in the aforesaid McMath et al application, the cut out portion (not shown), which extends for the length of the hollow cylindrical portion 90 of the slidable member 78, provides communication from the interior of the slidable member 78 to a vapor return passage (not shown) in the body 10. The vapor return passage (not shown) in the body 10 communicates through a hose (not shown) with the vapor recovery equipment as more particularly shown and described in the aforesaid McMath et al application.

When the spout 15 has its free end inserted in the fill pipe opening 16 as shown in FIG. 2, the spring 76 is compressed. This causes the spring 91 to be overcome to move the slidable member 78 and the resilient disc 85 away from the annular projection 84 on the ring 80. This results in the annular passage 27 no longer being sealed by the resilient disc 85 engaging the annular projection 84 on the ring 80 so that vapor can flow from the vehicle tank, which is being filled, through its fill pipe 17, the opening 16 of the fill pipe 17, the opening 26 in the sealing means 25, the annular passage 27, the cut out portion (not shown) in the slidable member 78, and the vapor return passage (not shown) in the body 10 to the vapor return hose (not shown).

Thus, the vapor recovery equipment, which is connected to the vapor return hose (not shown), communicates with the vehicle tank being filled to receive the vapor therefrom. However, it cannot communicate with the atmosphere because the resilient disc 85 moves away from the annular projection 84 on the ring 80 only after the spring 76 has been compressed sufficiently through disposing the free end of the spout 15 within the fill pipe opening 17 and holding it therein by the latch ring 28.

Vapor cannot flow between the bellows 23 and the portion 88 of the slidable member 78 because a portion 98 of the bellows 23 is disposed in a groove 99 in the portion 88 of the slidable member 78 and retained therein by a clamp 99'. The free end of the bellows 23 is retained against the body 10 by the clamp 24. As a result of clamping the bellows 23 by the clamp 24 and retaining the portion 98 in the groove 99 of the slidable member 78 by the clamp 99', a portion 100 of the bellows 23 flexes when the slidable member 78 is moved from the position of FIG. 1 to the position of FIG. 2 to enable vapor flow to occur from the annular passage 27 to the vapor return hose (not shown).

The slidable member 78 also functions as an interlock sleeve to allow liquid flow through the body 10 only if the sealing means 25 is in sealing engagement with the end of the fill pipe 17 when the spout 15 is inserted in the fill pipe opening 16 to supply the liquid thereto as more particularly shown and described in my aforesaid application for "Automatic Shut-Off Nozzle With Vapor Return Seal." Thus, the slidable member 78 functions in the manner shown and described in my aforesaid application for "Automatic Shut-Off Nozzle With Vapor Return Seal" to control liquid flow through the spout 15 and has the resilient disc 85 thereon to control vapor flow from the annular passage 27 to the vapor return hose (not shown) so that the vapor recovery equipment, which is connected to the vapor return hose (not shown), cannot communicate with the atmosphere at any time.

In the assembly of the sealing means 25 on the outer end of the bellows 23, the bellows 23 will have been clamped to the body 10 by the clamp 24 so that the enlarged portion 51 is on top of the spout 15. The spring 76 will have already been connected to the slidable member 78. Then, the end cap 43 is slid over the outer surface of the outer end of the bellows 23. Next, the looped end 75 (see FIG. 6) of the spring 76 is positioned within the passage 74 in the ear 73 of the swivel plate 44.

The enlarged portion 64 (see FIG. 1) of the bellows 23 is disposed in the groove 67 in the swivel plate 44 and the portion 66 of the enlarged portion 64 is positioned in the reduced portion 69 of the groove 67. Then, the end cap 43 is positioned so that the deeper groove 53 in the end cap 43 receives the enlarged portion 51 of the bellows 23 and the centering pin 54 enters the passage 55 in the swivel plate 44. This results in the circumferential groove 52 in the end cap 43 receiving the circumferential bead 50 on the outer surface of the outer end of the bellows 23. This rotationally orients the end cap 43 and the swivel plate 44 relative to the body 10 and the spout 15.

The seal plate 36 is next inserted into the chamber 37 in the sealing member 33. Then, the sealing member 33, which has the seal plate 36 supported thereby, is inserted so that the outer projection 34 of the sealing member 33 enters between the inner surface 61 (see FIG. 11) of the flange 60 of the end cap 43 and the circumference of the flat portion 56 (see FIGS. 13–15) of the swivel plate 44. The inner projection 35 (see FIGS. 3 and 4) of the sealing member 33 enters the groove 70 (see FIGS. 1, 13, and 14) of the swivel plate 44.

At the time of so disposing the projection 34 (see FIGS. 3 and 4) and 35 of the sealing member 33, the sealing member 33 is positioned so that the centering pin 54 (see FIGS. 10 and 11) of the end cap 43 enters the passage 57 (see FIG. 5) in the seal plate 36 and the recess 58 (see FIGS. 3 and 4) in the sealing member 33. This rotationally orients the sealing member 33 relative to the body 10 (see FIG. 1) and the spout 15 since the end cap 43 is already so oriented.

With the sealing member 33 so disposed, each of the passages 46 (see FIGS. 6 and 10–12) in the end cap 43 is aligned with one of the passages 47 (see FIGS. 6 and 13) in the swivel plate 44, one of the holes 48 (see FIGS. 5 and 6) in the seal plate 36, and one of the recesses 49 (see FIGS. 3, 4, and 6) in the sealing member 33. Then, each of the self-tapping screws 45 (see FIG. 6) is passed through the aligned passages 46 and 47 and taps threads within the aligned hole 48 in the seal plate 36 before extending into the aligned recess 49 in the sealing member 33. This fastens the sealing member 33, the swivel plate 44, and the end cap 43 to each other and to the bellows 23.

Each of the sealing member 33 (see FIG. 3), the seal plate 36 (see FIG. 5), the flat portion 56 (see FIG. 13) of the swivel plate 44, and the end cap 43 (see FIG. 10) is formed with its opening concentric to its periphery so that the peripheries are eccentric relative to the longitudinal axis of the bellows 23 (see FIG. 1). Thus, since the longitudinal axis of the spout 15 is aligned with the longitudinal axis of the bellows 23, each of the sealing member 33, the seal plate 36, the swivel plate 44, and the end cap 43 is eccentric with respect thereto. This eccentricity and the connection of the spring 76 to the top of the sealing means 25 enables the force from the spring 76 to be applied primarily to the top portion of the sealing member 33. This is where the maximum force is required on the sealing member 33 when the spout 15 is inserted downwardly into the fill pipe 17 (see FIG. 2).

Considering the operation of the present invention, the free end of the spout 15 is inserted into the fill pipe opening 16. As the spout 15 is inserted into the fill pipe opening 16, the sealing member 33 of the sealing means 25 engages the end of the fill pipe 17 as shown in FIG. 2.

As the spout 15 continues to be moved into the fill pipe opening 16, the bellows 23 and the spring 76 are compressed. This is because the bellows 23 is fixed to the body 10, which has the spout 15 connected thereto so that the body 10 is moving towards the fill pipe 17 while the outer end of the bellows 23 secured to the sealing means 25 cannot move.

Since the swivel plate 44, which has the looped end 75 (see FIG. 6) of the spring 76 pivotally connected thereto, is part of the sealing means 25, the swivel plate 44 also is prevented from movement with the spout 15 (see FIG. 2) as the spout 15 moves into the fill pipe opening 16. As the spout 15 is advanced into the fill pipe 17 after the spring 76 has been compressed to load the sealing means 25, the spring 91 is overcome so that the resilient disc 85 on the slidable member 78 is moved away from the annular projection 84 on the ring 80, which is mounted on the spout 15. When this occurs, vapor flow can occur from the annular passage 27 to the vapor return hose (not shown). Further insertion of the spout 15 into the fill pipe 17 is accommodated by additional compression of the spring 76. This is to accommodate fill pipes of various construction.

The total motion of the slidable member 78 relative to the ring 80 and the nozzle body 10 is limited by a face 101 of the slidable member 78 engaging front end 102 of the body 10. Thus, there is a maximum compression of the spring 91.

When flow through the spout 15 is stopped, either automatically or manually as discussed in my aforesaid application for "Automatic Shut-Off Nozzle With Vapor Return Seal," the spout 15 is removed from the fill pipe opening 16. During removal of the spout 15 from the fill pipe opening 16, the spring 76 starts to expand first.

When the spring 76 has expanded sufficiently so that the forces produced by the springs 76 and 91 are equal, the spring 91 begins to expand but at a different rate than that at which the spring 76 is still expanding. As a result, the springs 76 and 91 cooperate to cause the resilient disc 85 to be moved into engagement with the annular projection 84 on the ring 80 during removal of the spout 15 from the fill pipe opening 16.

When the resilient disc 85 engages the annular projection 84 on the ring 80, the spring 76 has still not completed its expansion so that it is still exerting a force against the sealing means 25 to cause the sealing means 25 to be in sealing engagement with the fill pipe 17. Therefore, the check valve 79 is closed before the sealing means 25 ceases to have sealing engagement with the fill pipe 17. This insures that communication between the annular passage 27 and the vapor return hose (not shown) is blocked before the sealing means 25 ceases to have sealing engagement with the fill pipe 17.

While the present invention has shown and described the resilient disc 85 as being mounted on the slidable member 78, it should be understood that the ring 80 could have the resilient sealing disc 85 formed thereon. In this arrangement, the annular projection 85 would be removed from the ring 80 and an annular projection formed on the slidable member 78.

While the present invention has been shown and described as being utilized with the check valve 79 of my aforesaid application for "Liquid Dispensing Nozzle Having A Sealing Arrangement For Vapor Return Means," it should be understood that any suitable type of check valve could be employed. While the present invention has shown and described the sealing means 25 being utilized in conjunction with the check valve 79, it should be understood that a check valve is not necessary for satisfactory operation of the sealing means 25.

While the present invention has been shown and described as being employed with the slidable member 78, it should be understood that the slidable member could be omitted when the check valve 79 is not utilized. In this arrangement, it would be necessary to secure the tab end of the spring 76 to a portion of the body 10.

An advantage of this invention is that the seal may be easily assembled to the bellows. Another advantage of this invention is that the seal is less expensive than previously available seals because of the reduction of the expense of assembly. A further advantage of this invention is that the seal may be easily replaced. Still another advantage of this invention is that it insures sealing engagement of the seal with fill pipes having different angles.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

What is claimed is:

1. A liquid dispensing nozzle comprising a body; a spout extending from said body and having its free end for disposition in an opening of a fill pipe or the like; means to return vapor from the tank being filled; sealing means to form a seal between the fill pipe opening and said vapor return means when said spout is disposed in the fill pipe; means to continuously urge said sealing means towards the free end of said spout; said sealing means including means to provide communication from the tank being filled to said vapor return means when said sealing means is in sealing engagement with the fill pipe, a sealing member having a surface engaging the fill pipe, and said sealing member having its fill pipe engaging surface eccentrically disposed with respect to the longitudinal axis of said spout when in a rest position; and means to connect said sealing means to said vapor return means.

2. The nozzle according to claim 1 in which said vapor return means includes a compressible member disposed in spaced relation to said spout to form an annular passage therebetween, one end of said compressible member is secured to said body; and said connecting means includes a first member engaging the outer surface of the other end of said compressible member, a second member engaging the inner surface of the other end of said compressible member, and means to hold said first and second members in clamping engagement with the other end of said compressible member and in engagement with each other and said sealing member.

3. The nozzle according to claim 2 in which said second member of said connecting means has means pivotally connected to said continuously urging means.

4. The nozzle according to claim 3 in which said continuously urging means includes a spring having one end connected so as to not have relative rotation with respect to said spout and said pivotally connected means includes means connected to the other end of said spring to enable said sealing member to pivot about two orthogonal axes with respect to said spout and said spring.

5. The nozzle according to claim 3 in which said pivotally connected means is disposed only above the top of said spout to cause the force of said continuously urging means to act on the top of said sealing member.

6. The nozzle according to claim 2 in which said continuously urging means includes a spring having one end connected so as to not have relative rotation with respect to said spout and said second member of said connecting means includes means connected to the other end of said spring to enable said sealing means to pivot about two orthogonal axes with respect to said spout and said spring.

7. The nozzle according to claim 1 in which said sealing member has the maximum eccentricity of its fill pipe engaging surface on top of said spout.

8. The nozzle according to claim 7 in which said vapor return means includes a compressible member disposed in spaced relation to said spout to form an annular passage therebetween, one end of said compressible member is secured to said body; and said connecting means includes a first member engaging the outer surface of the other end of said compressible member, a second member engaging the inner surface of the other end of said compressible member, and means to hold said first and second members in clamping engagement with the other end of said compressible member and in engagement with each other and said sealing member.

9. The nozzle according to claim 8 in which said continuously urging means includes a spring having one end connected so as to not have relative rotation with respect to said spout and said second member of said connecting means includes means connected to the other end of said spring to enable said sealing means to pivot about two orthogonal axes with respect to said spout and said spring.

10. The nozzle according to claim 1 in which said continuously urging means includes a spring having one end connected so as to not have relative rotation with respect to said spout and said sealing means includes means connected to the other end of said spring to enable said sealing means to pivot about two orthogonal axes with respect to said spout and said spring.

11. The nozzle according to claim 1 in which said vapor return means includes a compressible member disposed in spaced relation to said spout to form an annular passage therebetween, one end of said compressible member is secured to said body, said compressible member includes means to orient the rotational position of said compressible member on said body at the time of securing the one end of said compressible member to said body and said sealing means has means to cooperate with said orienting means to dispose the maximum eccentricity of the fill pipe engaging surface of said sealing member at a desired position with respect to the longitudinal axis of said spout.

12. A liquid dispensing nozzle comprising a body; a spout extending from said body and having its free end for disposition in an opening of a fill pipe or the like; means to return vapor from the tank being filled, said vapor return means including a compressible member disposed in spaced relation to said spout to form an annular passage therebetween, one end of said compressible member being secured to said body; sealing means to form a seal between the fill pipe opening and said vapor return means when said spout is disposed in the fill pipe; means to continuously urge said sealing means towards the free end of said spout; and said sealing means including means to provide communication from the tank being filled to said annular passage when said sealing means is in sealing engagement with the fill pipe, a sealing member engaging the fill pipe, and means to connect said sealing means to the other end of said compressible member, said connecting means of said sealing means including a first member engaging the outer surface of the other end of said compressible member, a second member engaging the inner surface of the other end of said compressible member, and means to hold said first and second members in clamping engagement with the other end of said compressible member and in engagement with each other and said sealing member.

13. The nozzle according to claim 12 in which said second member of said connecting means of said sealing means has means pivotally connected to said continuously urging means.

14. The nozzle according to claim 13 in which said holding means includes a plate supported by said sealing member of said sealing means, and connectors extending through said first and second members of said connecting means of said sealing means and releasably attached to said plate.

15. The nozzle according to claim 14 in which said connectors include self-tapping screws, said first and second members of said connecting means of said sealing means have aligned passages for said screws, and said screws tap into said plate.

16. The nozzle according to claim 15 in which said first member of said connecting means of said sealing means has means cooperating with said second member of said connecting means of said sealing means to align said passages in said first and second members of said connecting means of said sealing means.

17. The nozzle according to claim 13 in which said continuously urging means includes a spring having one end connected so as to not have relative rotation with respect to said spout and said pivotally connected means of said second member of said connecting means of said sealing means includes means connected to the other end of said spring to enable said sealing member to pivot about two orthogonal axes with respect to said spout and said spring.

18. A liquid dispensing nozzle comprising a body; a spout extending from said body and having its free end for disposition in an opening of a fill pipe or the like; means to return vapor from the tank being filled, said vapor return means including a compressible member disposed in spaced relation to said spout to form an annular passage therebetween, one end of said compressible member being secured to said body; sealing means to form a seal between the fill pipe opening and said vapor return means when said spout is disposed in the fill pipe; means to continuously urge said sealing means towards the free end of said spout; and said sealing means including means to provide communication from the tank being filled to said annular passage when said sealing means is in sealing engagement with the fill pipe, a sealing member engaging the fill pipe, means pivotally connected to said continuously urging means, and means to releasably connect said sealing member of said sealing means to the other end of said compressible member and said pivotally connected means, and said releasably connecting means including a plate supported by said sealing member of said sealing means, means supported by said compressible member, and connectors extending through said supported means and said pivotally connected means and releasably attached to said plate.

19. The nozzle according to claim 18 in which said connectors include self-tapping screws, said supported means and said pivotally connected means have aligned passages for said screws, and said screws tap into said plate.

20. The nozzle according to claim 19 in which said supported means has means cooperating with said pivotally connected means to align said passages in said supported means and said pivotally connected means.

21. The nozzle according to claim 20 in which said continuously urging means includes resilient means surrounding said spout and said pivotally connected means includes means to enable said sealing means to pivot about two orthogonal axes with respect to said spout.

22. The nozzle according to claim 19 in which said continuously urging means includes resilient means surrounding said spout and said pivotally connected means includes means to enable said sealing means to pivot about two orthogonal axes with respect to said spout.

23. The nozzle according to claim 18 in which said continuously urging means includes resilient means surrounding said spout and said pivotally connected means includes means to enable said sealing means to pivot about two orthogonal axes with respect to said spout.

24. A liquid dispensing nozzle comprising a body, a spout extending from said body and having its free end for disposition in an opening of a fill pipe or the like, means to return vapor from the tank being filled, sealing means to form a seal between the fill pipe opening and said vapor return means when said spout is disposed in the fill pipe, resilient means disposed in surrounding relation to said spout, means pivotally connecting said resilient means to said sealing means to have said resilient means continuously urge said sealing means towards the free end of said spout, and said pivotally connecting means including means to enable said sealing means to pivot about two orthogonal axes with respect to said spout.

25. The nozzle according to claim 24 in which said resilient means includes a spring having one end connected so as to not have relative rotation with respect to said spout and said sealing means includes means connected to the other end of said spring to enable said sealing means to pivot about two orthogonal axes with respect to said spout and said spring.

26. The nozzle according to claim 25 in which said sealing means includes a compressible member engaging the fill pipe, said connected means of said sealing means includes a swivel plate connected to said compressible member of said sealing means, and said swivel plate has passage means to receive the other end of said spring to enable pivoting of said sealing means about the two orthogonal axes.

* * * * *